US005600945A

United States Patent [19]

Schmidke et al.

[11] Patent Number: 5,600,945

[45] Date of Patent: Feb. 11, 1997

[54] METHOD AND APPARATUS FOR MANIPULATING A SLIVER DURING CLEANING OF AN OPEN-END SPINNING STATION

[75] Inventors: Waldemar Schmidke, Aachen; Jürgen Backhaus, Wegberg; Willi Wilms; Harry Gatzke, both of Mönchengladbach, all of Germany

[73] Assignee: W. Schlafhorst AG & Co., Moenchengladbach, Germany

[21] Appl. No.: 514,761

[22] Filed: Aug. 14, 1995

[30] Foreign Application Priority Data

Aug. 12, 1994 [DE] Germany ..... 44 28 580.9

[51] Int. Cl.[6] ..... D01H 11/00; D01H 5/00

[52] U.S. Cl. ..... 57/301; 57/263; 57/412

[58] Field of Search ..... 57/263, 301, 281, 57/412

[56] References Cited

U.S. PATENT DOCUMENTS

| | | | |
|---|---|---|---|
| 4,038,812 | 8/1977 | Stahlecker | 57/301 |
| 4,055,942 | 11/1977 | Stahlecker | 57/156 |
| 4,150,534 | 4/1979 | Raasch | 57/281 |
| 4,932,201 | 6/1990 | Meroni et al. | 57/263 |
| 4,939,895 | 7/1990 | Raasch et al. | 57/263 |
| 4,982,563 | 1/1991 | Stahlecker | 57/263 |
| 5,293,739 | 3/1994 | Brockmanns et al. | 57/263 |
| 5,313,775 | 5/1994 | Binder et al. | 57/261 |
| 5,343,686 | 9/1994 | Buchner et al. | 57/263 |
| 5,414,985 | 5/1995 | Ball et al. | 57/263 |

FOREIGN PATENT DOCUMENTS

| | | |
|---|---|---|
| 2658441A1 | 6/1978 | Germany . |
| 2458538C2 | 7/1982 | Germany . |
| 4204044A1 | 2/1993 | Germany . |

*Primary Examiner*—William Stryjewski
*Attorney, Agent, or Firm*—Shefte, Pinckney & Sawyer

[57] ABSTRACT

Spinning stations of open-end spinning frames are cleaned from time to time to increase productivity, e.g. each time a sliver can change is made although, if the times between the exchange of two cans are too long, cleaning may be performed at a preset cycle. The sliver must be removed from the spinning station for this purpose. To be able to reintroduce a defined length of the removed sliver into the spinning station at the end of a cleaning operation, the end of the sliver is aspirated from between the draw-in roller and the gripping table of the spinning station by means of an aspiration and blower nozzle and pulled out of the spinning box of the spinning station and, after the cleaning operation, the sliver is introduced into the spinning station by means of the aspiration and blower nozzle. The aspiration nozzle has an insert with bores for causing the tip end of the sliver to assume a particular shape.

15 Claims, 4 Drawing Sheets

METHOD AND APPARATUS FOR MANIPULATING A SLIVER DURING CLEANING OF AN OPEN-END SPINNING STATION

FIELD OF THE INVENTION

The present invention relates generally to the cleaning of a spinning station of an open-end spinning frame, and more particularly to a method of cleaning open-end spinning stations of the type wherein the sliver is fed to a draw-in roller of an opening device via an introduction funnel, commonly referred to as a condenser, while the sliver is pressed against the draw-in roller by means of a gripping table during spinning and to an apparatus for manipulated handling of the sliver at the spinning station.

BACKGROUND OF THE INVENTION

In open-end spinning frames, a sliver is drawn into the spinning frame from sliver cans standing below the spinning station. During a can change, or if the sliver breaks below the spinning frame, the sliver must be reintroduced into the funnel to the opening device of the open-end spinning station. This operation can be done manually, but can changing devices are known which utilize a manipulator which can introduce the sliver automatically into the insertion funnel of the opening device of a spinning station. A method as well as a device for the automatic feeding of the sliver are disclosed in German Patent Publication DE 42 04 044 A1.

To increase the productivity of open-end spinning frames, it is customary to clean the spinning stations from time to time, which can be done every time a can change is performed, for example. However, since the spinning of a sliver from a can takes several hours, the degree of soiling after such time can already have reached a state where it reduces spinning production. For this reason, it is customary to perform cleaning of the spinning stations, and of the rotors in particular, in accordance with a preset timed cycle. In this connection it is possible to equip a service device, for example a yarn attachment carriage, with cleaning tools, or to position a device specially provided for cleaning purposes at the respective spinning stations in order to perform the required cleaning work. The ongoing spinning operation is interrupted in this case.

SUMMARY OF THE INVENTION

It is accordingly an object of the present invention to provide a method and apparatus for improving the cleaning operation in an open-end spinning frame.

Briefly summarized, the present invention accomplishes the foregoing objective by a method for cleaning a spinning station of an open-end spinning frame of the type wherein the sliver is fed to a draw-in roller of an opening device via a sliver condenser and the sliver is held against the draw-in roller by a gripping table during spinning. According to the present invention, the cleaning method basically comprises the steps of stopping the draw-in roller and separating the gripping table from the draw-in roller. An end of the sliver is then aspirated from between the separated draw-in roller and the gripping table by means of a switchable nozzle which can be selectively operated in a suction aspiration mode and a forced air blowing mode. A defined length of the sliver end is retained in a fixed disposition following its removal from between the draw-in roller and the gripping table while the cleaning operation is performed. After the cleaning operation, the sliver end is reinserted between the draw-in roller and the gripping table by means of the aspiration and blower nozzle for restarting the spinning operation.

The present invention also provides a novel manipulator for handling the sliver during a cleaning operation at a spinning station, the manipulator basically comprising a nozzle means for aspirating and blowing a sliver end. The nozzle means has suitable means for picking up the sliver end from and inserting the sliver end into the spinning station utilizing a tubular sliver receiving funnel communicating with a sliver obstructing insert. According to the invention, the insert has a plurality of air flow openings annularly arranged about a air flow line centrally through the funnel. An actuator is also provided for opening the condenser and for inserting the sliver end between the draw-in roller and the gripping table.

Thus, the present invention basically contemplates that the sliver is removed for performing a cleaning operation at a spinning station so that cleaning can also include the sliver feed device. In this manner, improved cleaning results and thus improved spinning results are achieved. The invention discloses the means for performing this improved cleaning automatically. Drawing in of the sliver must be stopped whereby a yarn break automatically occurs. For cleaning the opening device it is necessary to remove the end of the sliver extending into it and, for this purpose, the gripping table is lifted off the draw-in roller, which can be done by means of an actuator disposed on the manipulator for handling the sliver. In accordance with the invention, a combined aspiration and blower nozzle, disposed on the manipulator and extending to the gripping gap between the gripping table and the draw-in roller, aspirates the sliver end and pulls it out of the area of the condenser following the opening of the gripping table to hold the sliver during the cleaning operation.

In a preferred embodiment of the invention, the sliver can be gripped at a defined location below the insertion funnel, i.e.,the so-called condenser, before the sliver is removed, following which the aspiration and blower nozzle can release the end of the sliver so that it hangs over the gripper and can be gripped by the manipulator. The gripper can be disposed either at the spinning station or on the service device which performs cleaning. If the sliver gripper is disposed at the spinning station, the sliver preferably moves through the opened sliver gripper during the spinning operation. When the spinning operation is interrupted, the manipulator actuates the gripper so that the drawing-in of the sliver is stopped and a defined length of sliver is ready for inserting the sliver for the fresh yarn attachment operation. If the gripper is disposed on the service device, the sliver is first grasped by the gripper or it is placed into the gripper and fixed in place therein.

In accordance with the invention, an exactly defined length of sliver extends in both cases from the sliver gripper for the yarn reattachment operation, which can be advantageously grasped at a defined location by the manipulator and thus easily inserted into the spinning station. In this manner, the yarn attachment operation can be directly started with a defined sliver cross section, so that only small amounts of waste are generated in the course of the yarn attachment operation. It is also prevented that the sliver is grasped above its actual end possibly causing sliver loops to be introduced into the spinning station, which can lead to obstructions in the condenser and therefore to additional interruptions of the spinning operation. Unsuccessful gripping steps caused by too short a sliver end are also avoided.

The aspiration and blower nozzle in accordance with the present invention is constructed to directly impart a shape to the aspirated sliver end, which is advantageous for reinsertion into the gripping gap between the gripping table and the draw-in roller. Specifically, the nozzle has a funnel-shaped cross section which imparts a pointed, flame-shaped form to the sliver end, and thereby considerable eases the insertion of the sliver end into the gap between the gripping table and the draw-in roller. The funnel-shaped design of the aspiration and blower nozzle also allows the aspiration of slivers of different sliver cross sections. The tips of the sliver ends are condensed and are given a cone-shaped cross section. Such a shape of the sliver end also makes blowing the sliver end out of the aspiration and blower nozzle and insertion of the blown sliver end into the gripping gap between the gripping table and the draw-in roller easier, because the shape of the sliver end eases its exit from the aspiration and blower nozzle.

According to another aspect of the invention, the aspiration and blowing nozzle has an insert portion formed with an annular arrangement of openings which, when blowing air is supplied to the aspiration and blower nozzle, results in an air flow directed to the outer annular periphery of the sliver tip and in this way aids in blowing the sliver end out of the aspiration and blower nozzle. A centrally disposed opening in the insert aids in the blow-out effect. However, this central opening is considerably smaller than the annular arrangement of openings surrounding it. During the aspiration of the sliver, the insert limits the length to which the sliver is aspirated into the aspiration and blower nozzle.

According to a further aspect of the invention, a screen is placed in front of the insert which effectively prevents the penetration of fibers into the openings of the insert. In this manner, it is prevented that the tip of the sliver end is thinned out by the removal of fibers which are aspirated through the openings of the insert. Furthermore, unnecessary soiling of the pneumatic system of the spinning station is prevented by keeping out the fibers. If, following the blowing out of the sliver end during its insertion into the condenser and introduction into the gripping gap, fibers should be caught in front of the screen, the aspiration and blower nozzle can be cleaned of possibly retained fibers and fiber remnants by blowing them out subsequent to the reinsertion of the sliver.

If the screen is substantially flat so as to extend perpendicularly in respect to the axis of the aspiration and blower nozzle, it has an increased resistance against flow of aspiration or compressed air than if the screen is concavely or semispherically shaped. A concave screen shape favors the desired formation of a tip at the end of the sliver.

DETAILED DESCRIPTION OF THE PREFERRED EMBODIMENT

Figures 1, 1A:
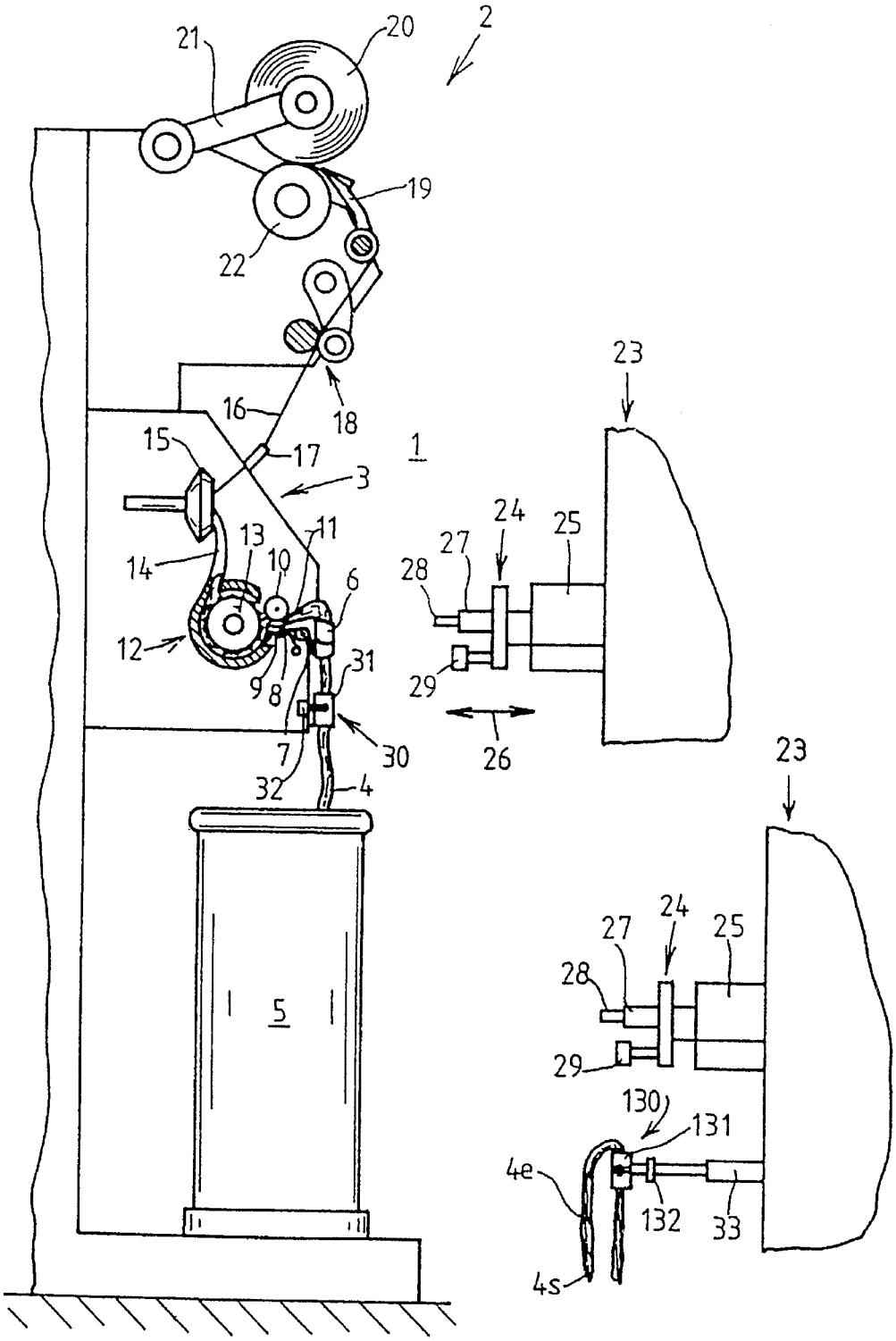
FIG. 1 is a side elevational view of one spinning station of an open-end spinning frame in accordance with the present invention with a sliver manipulator positioned on a traveling service device.
FIG. 1*a* shows an alternative form of service device with a sliver manipulator and a sliver gripper.

Referring now to the accompanying drawings and initially to FIG. 1, a spinning station 1 of an open-end spinning frame 2 of the type which comprises a plurality of spinning stations arranged in alignment to each other is shown in side view. Only those characteristics aiding in understanding the invention are represented and described.

A so-called spinning box 3 is located at each of the spinning stations, into which the sliver 4 is introduced via an insertion funnel 6 for the sliver, commonly referred to as a so-called condenser, from sliver cans 5 placed underneath the spinning boxes 3. The condenser 6 is seated pivotably on a shaft 7 in the housing of the spinning box 3. It is advantageous for purposes of the present invention if the condenser 6 has a design which corresponds to the sliver feed device represented in FIG. 8 of German Patent Publication DE 42 04 044 A1. The condenser 6 has a gripping table 9 which is pressed against a draw-in roller 10 by means of a spring 8. The sliver is fed through a sliver gripping gap 11 between the gripping table 9 and the draw-in roller 10 to an opening device 12, in which the sliver 4 is opened in a known manner by means of an opening roller 13 into individual fibers, which are then fed through a fiber guide channel 14 to a spinning rotor 15 wherein the fibers are spun in a known manner into a yarn 16. The yarn is drawn from the rotor 15 by a pair of driven draw-off rollers 18 through a small draw-off tube 17 and is deposited on a cheese 20 by a yarn guide 19. The cheese 20 is held by a pivotable bobbin holder 21 and rests with its circumferential surface on a driven winding roller 22 which thereby drives the cheese.

A service device 23 is shown in FIG. 1 to be positioned in front of the spinning station 1. By way of example, this service device 23 can be a can changing carriage, such as is known from German Patent Publication DE 42 04 044 A1. However, the service device can also be a yarn attachment carriage, a cheese changing carriage or any other form of service device which travels along the spinning frame and can be equipped for the specific purpose of cleaning the spinning stations or the spinning frame. For this reason, this service device is not shown in detail.

The service device 23 is equipped with a sliver manipulator 24 which is also not shown in detail. The manipulator 24 can be extended from the service device 23 to each spinning station 1 via a telescoping carriage 25 as indicated by the two-headed arrow 26. The manipulator 24 has a pivotable head 27 with an aspiration nozzle 28 as well as an actuator 29 for opening the sliver feed device, i.e., the condenser 6, at any one of the spinning boxes 3 for introducing the sliver. The structure of the manipulator 24 in this exemplary embodiment can correspond to the exemplary embodiments represented and described in German Patent Publication DE 42 04 044 A1.

From German Patent Publication DE 42 04 044 A1 it is known how the sliver is inserted at a spinning station by means of the manipulator 24 following a sliver can change. When cleaning a spinning station, the process in accordance with the invention is performed as follows:

The draw-in roller 10 is stopped whereby the feeding of fibers to the rotor 15 is interrupted and the yarn 16 necessarily breaks. Simultaneously with the stoppage of the draw-in roller, the sliver 4 is gripped at a defined location below the condenser 6. A sliver gripper 30 is provided for this purpose below the condenser 6 in the instant exemplary embodiment. The sliver gripper 30 can consist, for example, of two mating gripping elements 31 which can be moved selectively toward and away from one another and are normally open during the spinning operation. These two gripping elements 31 are actuated into engagement against each other by means of motor-driven or electromagnetic actuators 32 for holding the sliver 4 during the cleaning operation. Because the draw-in roller 10 is stopped, a piece of sliver of exactly defined length remains between the sliver gripper 30 and the gripping gap 11.

To be able to perform the cleaning operation, the end of the length of sliver is now removed from the-spinning station by means of the manipulator 24. To do so, the manipulator 24 is moved by means of the telescoping carriage 25 to the spinning box 3 and its pivotable head 27 is positioned in front of the condenser 6. The actuator 29 thereby comes into operational contact with the condenser 6 and lifts the gripping table 9 off the draw-in roller 10, which frees the sliver end in the gripping gap 11. The aspiration and blower nozzle 28 is advanced forwardly at the same time for aspirating the sliver end in the area of the gripping gap 11. This manner of manipulation of the condenser 6 is performed as described in German Patent Publication DE 42 04 044 A1.

The aspiration and blower nozzle 28 with the gripped sliver end is then retracted and releases the sliver end outside of the area of the condenser 6, so that the sliver end hangs downwardly over the sliver gripper 30. Since the sliver removed from the spinning box 3 has a defined length, it can always be grasped by the manipulator 24 at the same location and inserted into the spinning station for renewed yarn attachment.

Instead of being disposed on the spinning station itself, the sliver gripper 30 for holding the sliver can alternatively be disposed on the service device 23. This option is represented in FIG. 1*a* wherein a sliver gripper 130 is fastened below the manipulator 24 by means of an extensible and retractable holder 33. The two gripping elements 131, which can be opened and closed by means of the actuators 132, can be positioned by means of the holder 33 at a location below the condenser 6 for grasping the sliver 4. When the sliver 4 has been gripped, which is determined by means of a sensor (not shown ), the manipulator 24 is extended and opens the condenser 6 by means of the actuator 29 so that the aspiration and blower nozzle 28 can grip the sliver end remaining in the gripping gap 11. After the sliver end has been pulled out of the gripping gap 11, the manipulator 24 can be retracted and the aspiration and blower nozzle 28 can release the end of the sliver. The sliver end 4*e* then will hang over the sliver gripper 130 by a defined length, as illustrated in FIG. 1*a*. For reinsertion into the spinning box 3, the pivotable head 27 with the aspiration and blower nozzle 28 pivots downward and grips the tip 4s of the sliver end which, because of its defined length, always hangs at the same place and can therefore easily be gripped and aspirated by the aspiration and blower nozzle 28.

It is also possible that no form of sliver grippers 30 or 130 are provided, in which case the aspiration and blower nozzle 28 must maintain an aspirated grip on the sliver end during the entire cleaning operation.

Figure 2:
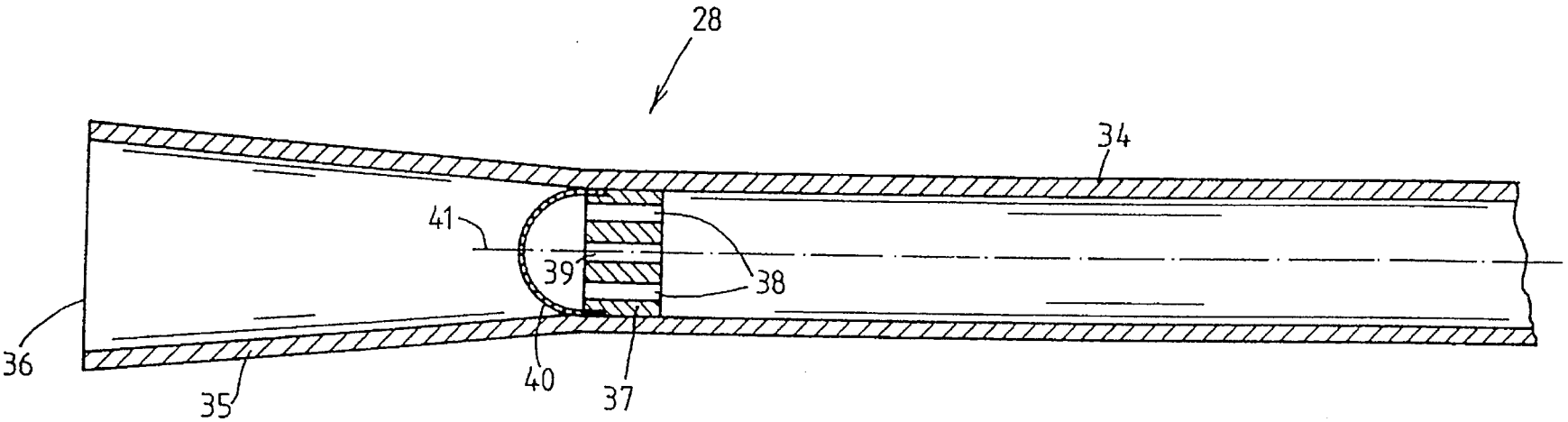
FIG. 2 is a cross section through an aspiration and blower nozzle in accordance with the invention.

An exemplary embodiment of an aspirating nozzle 28 in accordance with the present invention is illustrated in FIG. 2. The aspirating nozzle 28 consists of a tube 34 made of an elastic material, for example an elastic plastic material. In the present case, the tube has an exterior diameter of approximately 6 mm and an interior aspiration cross section of approximately 4 mm. The free end of the aspirating tube 28 widens over a distance of approximately 30 mm in the shape of a funnel 35, terminating in a mouth 36 of the funnel 35 which has an interior diameter of about 6 mm. The length of the funnel 35 as well as the diameter of the mouth and the usable interior diameter of the aspiration cross section can be adapted to the sliver which is to be processed, the thickness and the diameter of the sliver constituting the determinative factors for the design of the aspirating opening 36 and the funnel 35.

An insert 37 of approximately 5 mm length is fitted within the tube 34 at the transition between the funnel 35 and the tube 34 and is formed with bores 38 which are positioned in an annular arrangement around a central bore 39. The diameter of the bore 39 is less than the diameters of the annularly arranged bores 38. A screen 40 of a semispherical, convex shape is affixed at the front of the insert 37 facing the mouth 36 of the funnel 35.

Several exemplary embodiments for the combination of inserts 37 and screens are illustrated in FIGS. 3*a* to 3*e*.

Figures 3A, 3B, 3C, 3D, 3E:
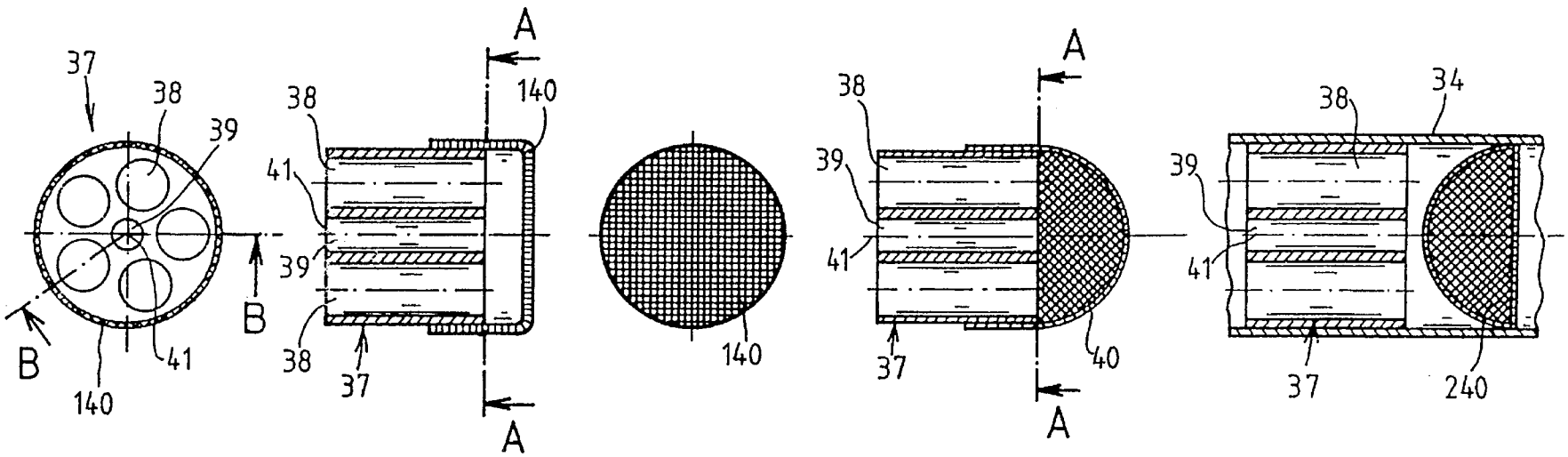
FIG. 3*a* is a front elevational view of a perforated insert of the aspiration and blower nozzle.
FIG. 3*b* is a cross sectional view through a perforated insert of the type of FIG. 3A and a flat screen insert disposed in combination with each other.
FIG. 3*c* is a front elevational view of a screen insert of the aspiration and blower nozzle.
FIG. 3*d* is a cross sectional view through a perforated insert of the type of FIG. 3*a* and a convex, semispherically-shaped screen insert disposed in combination with one another.
FIG. 3*e* is a cross sectional view through a perforated insert of the type of FIG. 3*a* and a semispherically-shaped, concave screen insert.

FIG. 3*a* shows a front elevational view of an insert 37 having a screen 140, which is substantially flat in contrast to the exemplary embodiment in FIG. 2, affixed to the front of the insert 37. The combination of the insert 37 with this flat screen 140 is illustrated in FIG. 3*b* in an axial section longitudinally through the insert 37 taken along the section line B—B shown in FIG. 3*a*. The front elevation of FIG. 3*a* likewise is taken along the section line A—A of FIG. 3*b*.

The front view of the insert 37 in FIG. 3*a* shows a number of bores 38 of substantially equal size formed in the front face of the insert and extending axially in parallel relation to one another along the length of the insert 37, the bores 38 being arranged annularly around a centrally disposed bore 39. In the present exemplary embodiment, the diameter of the central bore 39 is approximately one half of the diameters of the bores 38. As a result, a greater aspiration force is exerted by the aspiration flow on the constituent fibers of the sliver at its annular periphery than on the fibers at the central area within the sliver. Similarly, when blowing out the aspirated sliver, a greater pressure force is exerted on the annularly outwardmost fibers, so that the sliver, which becomes denser through the funnel 35 towards the tip, can be released more easily from the funnel 35.

As can be seen in FIG. 3*b*, the flat screen 140 is disposed in front of the insert 37 at a defined spacing from the front end of the insert 37, facing the funnel 35. FIG. 3*c* shows a top view of the screen 140.

In an alternative exemplary embodiment shown in FIG. 3*d*, a semispherically concave screen 40 is fitted on the front end of the insert 37. In comparison with the screen 140 in accordance with the embodiment in FIGS. 3*a*, 3*b* and 3*c*, the screen 40 in accordance with the embodiment in FIG. 3*d* hinders the throughput of air and thus the flow of the blowing or aspirating air is relatively lessened. FIG. 3*e* illustrates another embodiment wherein a semispherically-shaped screen 240 is disposed with its concave side facing the funnel 35.

The shape of the screens has an effect on the shaping of the tip of the sliver, i.e., the free end of the sliver, when it extends up to the screen. With a flat screen 140, the tip of the sliver is caused to flatten. With a screen 240 corresponding to FIG. 3*e*, the tip of the sliver is caused to become rounded.

The screens have the function of preventing the aspiration of the sliver into the insert 37. Furthermore, the screen constitutes a rough barrier against the aspiration of individual fibers into the tube 34. In addition, the exact length between the sliver end and the sliver gripper 30 or 130 is defined by means of the screen. When aspirating air is applied, the sliver is pulled into the funnel 35 and becomes denser, while the tip of the sliver is shaped conically. The screens form a barrier against continued aspiration of the sliver. Blowing out the sliver is aided by the arrangement of the openings in the insert 37 and by the funnel shape of the aspiration and blower nozzle. The blowing times can be kept very short, for example 30 msec, since the screen-shaped, compressed sliver end is quickly released. The arrangement of the bores 38 of the insert 37 allow a defined, flame-shaped air flow around the sliver during the blowing operation. When being inserted in the spinning box 3, the sliver end is thusly deposited in a flame shape when placed on the gripping table 9 in the area of the gripping gap 11. A reliable gripping of the sliver between the draw-in roller 10 and the gripping table 9 is thereby achieved.

Figure 4:
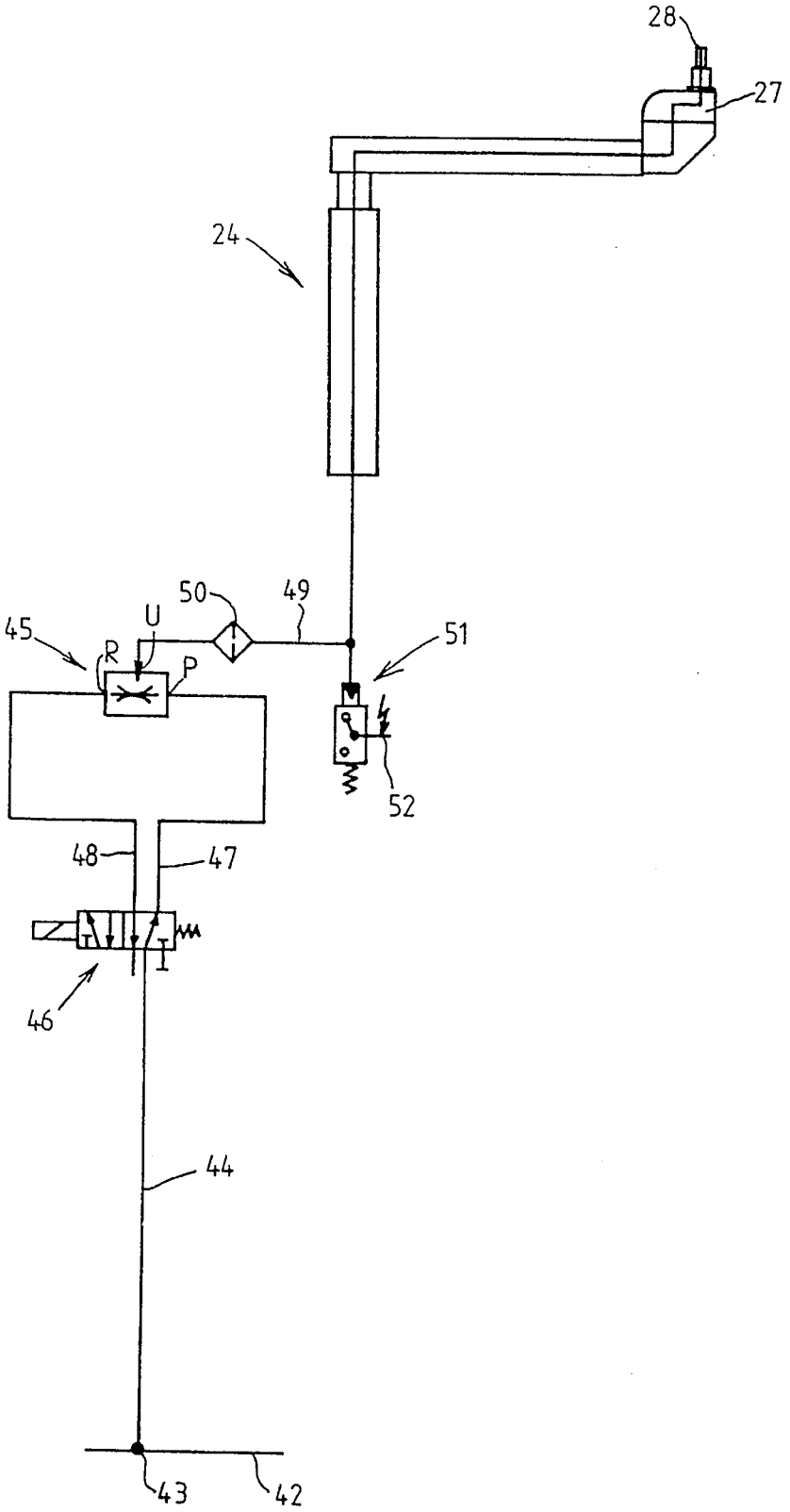
FIG. 4 is a schematic circuit diagram of the compressed air supply system for the aspiration and blower nozzle.

A pneumatic circuit diagram for the actuation and operation of the aspiration and blower nozzle 28 of the manipulator 24 is represented in FIG. 4. The service device 23, which is not shown, is supplied with compressed air from a central pneumatic supply line 42 of the spinning frame via a connection 43 through a branch line 44. Negative air pressure, i.e. suction, is required for aspirating the sliver end, which can be generated by directing compressed air to a vacuum aspiration nozzle as is represented symbolically at 45. A 5/2-way valve is placed upstream of this vacuum aspiration nozzle 45, which can be switched by a control device (not shown). In the present exemplary embodiment the compressed air line 44 is connected with a pneumatic line 47, which terminates at the connection point P forming the pressure connection of the vacuum aspiration nozzle 45. The compressed air flows through the vacuum aspiration nozzle 45, exits at the connection point R, which forms an outlet connection of the nozzle 45, and flows to the ambient atmosphere through the line 48. Negative pressure is thusly generated at the connection U, thereby forming the suction connection of the vacuum aspiration nozzle 45. A line 49 extends from the suction connection U to the pivotable head 27 of the manipulator 24 and terminates in the aspiration and blower nozzle 28.

If the 5/2-way valve 46 is actuated so that the compressed air line 44 is connected with the line 48, the outlet of the line 47 is blocked by the valve. The incoming compressed air therefore does not flow through the vacuum aspiration nozzle from the connection R to P, but instead enters the line 49 through the connection U. In this manner, the vacuum aspiration nozzle becomes a blower nozzle in contrast to its normal function and compressed air is caused to exit the aspiration and blower nozzle 48 whereby it operates as a blower nozzle. This circuitry as well as the use of a 5/2-way valve simplify the pneumatic installation in comparison with the alternative of utilizing two 3/2-way valves and associated controls.

A filter 50 is installed in the line 49 to prevent the entry of fibers which could be removed from the sliver during the application of suction to the aspiration and blower nozzle 48 and thereby drawn into the pneumatic installation.

A pressure switch 51 is also connected to the line 49 to actuate in response to increase in the negative pressure in the line 49 after the sliver is aspirated by the aspiration and blower nozzle 48 and enters the funnel 35. The increase in the suction pressure condition is reported via a signal line 52 to a control device (not shown) to indicate that the sliver has been properly aspirated. Thereupon, subsequent operating steps of the manipulator 24 can be actuated, for example, the reinsertion of the sliver into the spinning station or the release of the sliver when the sliver has just been aspirated out of the spinning station to make the spinning station available for cleaning. If the signals transmitted from the pressure switch to the control device indicate that the sliver has not been aspirated after a defined length of time, it is possible, for example, to perform additional searching movements for the sliver by means of the manipulator.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for cleaning a spinning station of an open-end spinning frame wherein a sliver is fed to a driven draw-in roller of an opening device via a sliver condenser and the sliver is held against the draw-in roller by a gripping table during spinning, the cleaning method comprising the steps of:

stopping the draw-in roller, separating the gripping table from the draw-in roller, aspirating an end of the sliver from between the separated draw-in roller and the gripping table by means of a switchable nozzle which is selectively operable in a suction aspiration mode and a forced air blowing mode, removing the aspirated sliver from the draw-in roller and the gripping table, retaining in a fixed disposition a defined length of the sliver end following its removal from between the draw-in roller and the gripping table, performing the cleaning operation of the spinning station; and after the cleaning operation re-inserting the sliver end between the draw-in roller and the gripping table by means of the aspiration and blower nozzle for restarting the spinning operation.

2. A method in accordance with claim 1, further comprising:

gripping the sliver at a defined location below the condenser following the stopping of the draw-in roller;

following both the gripping of the sliver and the aspiration of the sliver end from between the draw-in roller and the gripper table, releasing the sliver end from the aspiration and blower nozzle to hang from the sliver gripping location by a defined length, and following cleaning of the spinning station, aspirating the hanging end of the sliver and reinserting the sliver end into the spinning station.

3. A method in accordance with claim 2, further comprising gripping the sliver end at the spinning station.

4. A method in accordance with claim 2, further comprising gripping the sliver end at a service device for cleaning the spinning station.

5. A method in accordance with claim 1, further comprising maintaining the sliver in the aspirated state by the aspiration and blower nozzle during the cleaning operation.

6. A manipulator for handling a sliver during a cleaning operation at a spinning station of an open-end spinning frame wherein the sliver is fed to a draw-in roller of an opening device via a sliver condenser and the sliver is held against the draw-in roller by a gripping table during spinning, the manipulator comprising nozzle means for aspirating and blowing a sliver end, the nozzle means having means for picking up the sliver end from and inserting the sliver end into the spinning station including a tubular sliver receiving funnel communicating with a sliver obstructing insert having a plurality of air flow openings annularly arranged about an air flow line centrally through the funnel, and an actuator for opening the condenser and for inserting the sliver end between the draw-in roller and the gripping table.

7. A manipulator in accordance with claim 6, wherein the openings of the insert have the same diameter.

8. A manipulator in accordance with claim 6, wherein the insert includes a further opening disposed centrally of the annularly arranged openings, the diameter of the central opening being less than the diameters of the annularly arranged openings.

9. A manipulator in accordance with claim 6, wherein a screen is disposed at a side of the insert disposed towards the sliver receiving funnel.

10. A manipulator in accordance with claim 9, wherein the screen is concavely shaped.

11. A manipulator in accordance with claim 6, wherein the manipulator is disposed on a service device adapted to travel between the spinning stations of the spinning frame, the service device having a sliver gripper with actuable gripping elements for retaining the sliver outside of the spinning station during the cleaning operation.

12. A manipulator in accordance with claim 6, further comprising means for connecting the nozzle means to a pneumatic operating source comprising a vacuum aspiration nozzle having a suction connection, a pressure connection and an outlet, a first pneumatic line connecting the nozzle means to the suction connection of the vacuum aspiration nozzle, second and third pneumatic lines respectively connecting the pressure connection and the outlet of the vacuum aspiration nozzle with a 5/2-way valve, and a compressed air line extending between a compressed air source and the valve, the 5/2 way valve being switchable selectively between an aspirating mode connecting the compressed air line via the second line with the pressure connection of the vacuum aspiration nozzle and connecting the outlet of the vacuum aspiration nozzle via the third line with the atmosphere to apply an aspiration air force to the nozzle means and a compressed air blowing mode connecting the compressed air line via the third line with the outlet of the vacuum aspiration nozzle and closing the pressure connection via the second line by means of the valve so that the compressed air line is connected via the third line with the first line for compressed air flow via the suction connection of the vacuum aspiration nozzle into the nozzle means.

13. A method for preparing a spinning station of an open-end spinning frame for cleaning wherein a silver is fed to a driven draw-in roller of an opening device via a sliver condenser and the sliver is held against the draw-in roller by a gripping table during spinning, the method comprising the steps of:

stopping the draw-in roller, separating the gripping table from the draw-in roller, aspirating an end of the sliver from between the separated draw-in roller and the gripping table by means of a switchable nozzle which is selectively operable in a suction aspiration mode and a forced air blowing mode, removing the aspirated sliver from the draw-in roller and the gripping table, and retaining in a fixed disposition a defined length of the sliver end following its removal from between the draw-in roller and the gripping table.

14. A method in accordance with claim 13, further comprising:

gripping the sliver at a defined location below the condenser following the stopping of the draw-in roller.

15. A method in accordance with claim 14, wherein the retention step comprises: releasing the sliver end from the aspiration and blower nozzle to hang from the sliver gripping location by a defined length.

* * * * *